US008357025B2

(12) United States Patent
Brydon

(10) Patent No.: US 8,357,025 B2
(45) Date of Patent: Jan. 22, 2013

(54) OBJECT FOR COVERING BRA AND BIKINI CLASPS, AND MECHANISM FOR FASTENING SAME

(76) Inventor: Lesley Anne Brydon, Penticton (CA)

( * ) Notice: Subject to any disclaimer, the term of this patent is extended or adjusted under 35 U.S.C. 154(b) by 452 days.

(21) Appl. No.: 12/654,144

(22) Filed: Dec. 11, 2009

(65) Prior Publication Data

US 2011/0143635 A1 Jun. 16, 2011

(51) Int. Cl.
*A41C 3/00* (2006.01)

(52) U.S. Cl. ..... 450/58; 2/336; 24/3.12; 24/350; 24/507

(58) Field of Classification Search ..... 2/244, 242, 2/336, 338, 327, 326; 450/88, 86, 58; 24/3.12, 24/3.11, 350, 355, 507, 509–511
See application file for complete search history.

(56) References Cited

U.S. PATENT DOCUMENTS

| | | | | |
|---|---|---|---|---|
| 1,494,680 | A | 5/1924 | Fisk | |
| 1,852,188 | A * | 4/1932 | Phinney | 24/509 |
| 1,981,740 | A * | 11/1934 | Mix | 24/66.8 |
| 2,954,593 | A * | 10/1960 | Matelan | 24/13 |
| D267,909 | S | 2/1983 | Fildan | |
| 5,063,645 | A * | 11/1991 | Crespo | 24/501 |
| D337,745 | S | 7/1993 | Fildan | |
| 5,325,570 | A * | 7/1994 | Chin-Ho | 24/530 |
| D352,681 | S | 11/1994 | Fildan | |
| 5,380,238 | A | 1/1995 | Crew-Gee | |
| D356,525 | S | 3/1995 | Fildan | |
| D370,874 | S | 6/1996 | Muller et al. | |
| D385,509 | S | 10/1997 | Fildan | |
| 5,722,260 | A | 3/1998 | Mangano | |
| 5,816,889 | A | 10/1998 | Fildan | |
| 5,935,044 | A | 8/1999 | Brewster | |
| D414,719 | S | 10/1999 | Fildan | |
| 6,009,604 | A | 1/2000 | Fildan | |
| D433,965 | S | 11/2000 | Fildan et al. | |
| D440,905 | S | 4/2001 | Fildan et al. | |
| 6,223,399 | B1 * | 5/2001 | Chen | 24/3.1 |
| D449,562 | S | 10/2001 | Fildan et al. | |
| 6,385,657 | B1 * | 5/2002 | Parady | 709/251 |
| D475,653 | S | 6/2003 | Fildan et al. | |
| D486,294 | S | 2/2004 | Stuntz et al. | |
| 6,715,186 | B1 | 4/2004 | Huang | |
| 6,718,797 | B2 | 4/2004 | Plumly | |
| 7,198,541 | B2 | 4/2007 | Falla | |
| D561,641 | S | 2/2008 | Fildan et al. | |
| D580,819 | S | 11/2008 | Samuels et al. | |
| 8,156,616 | B2 * | 4/2012 | Lo | 24/516 |

* cited by examiner

*Primary Examiner* — Gloria Hale
(74) *Attorney, Agent, or Firm* — Anthony C. Edwards

(57) ABSTRACT

A decorative clasp for mounting to the fabric covered rear closure a bra or bikini top includes a decorative object having a front surface and opposite back surface. The front surface has mounted thereto decorative elements so as to adorn the decorative object. The back surface has a clamp mounted thereto having a base leg and a cooperating covering leg. The two legs cooperate so as to releasably clamp the rear closure of a bra or bikini top therebetween. A plurality of fabric penetrating protrusions are formed or mounted on at least one interior surface of the legs so that the fabric penetrating protrusions penetratingly engage with the threads or nap of the fabric of the rear closure.

16 Claims, 6 Drawing Sheets

OBJECT FOR COVERING BRA AND BIKINI CLASPS, AND MECHANISM FOR FASTENING SAME

FIELD OF THE INVENTION

This invention relates to the field of fasteners for feminine apparel which is worn around the chest or torso of the woman user, and in particular to a decorative clasp for covering the rear closure of a bra or bikini top.

BACKGROUND OF THE INVENTION

It is often desired by women to wear blouses, dresses, or the like which have plunging neck lines in the back of the garment so as to expose the woman's back and in particular to expose the woman's bra traps of the woman's brassiere or bra. Bra straps typically are not intended to be viewed publicly, but are, conversely, meant to be an undergarment, and thus are not generally particularly aesthetically pleasing to the eye at least in so far as the appearance of the fastening mechanism of the rear closure of the bra which retains the ends of the back straps together behind the woman's back when a bra or bikini top is worn.

Given the functional nature of such rear closures, and due to the fact that the back of the bra or bikini top is intended to be adjustable for lengths so as to accommodate different circumferences of the woman's torso, and also do to the fact that, at least bra straps, come in varying widths typically depending on the desire of comfort intended for the user which in turn often depends on the weight which is intended to be supported by the frontal cups and supporting straps depending therefrom.

Applicant is also aware of the problem sometimes encountered by large busted women who, when wearing so called tank tops, which are intended to cover the back bra straps, in fact do not do so as such women experience the back bra straps riding up above the upper edge of the tank top so as to expose the rear closure.

In the prior art, applicant is aware of U.S. Pat. No. 1,494,680 which issued to Fisk on May 20, 1924 for a Covered Elastic Fastener. Fisk discloses a covering means for concealing fasteners and also to provide a fastener for securing various feminine articles of wear, such, for instance, as shoulder straps, girdles, furs, hat bands, coats, bandeaux and garters. Fisk provides the covering means as including a back or base, and a front flap which is foldably attached to the base, and which parts are adapted to be temporarily secured as by a snap or other fasteners, the base part of which is provided with means complimentary to other fastening means attached to the article apparel to be secured about the person. Fisk further provides means for concealing the fastening means in an ornamental manner, describing a bow or other element that may be secured to and carried by a part of the covering structure.

What is not addressed, which is an object of the present invention to provide, is an improved decorative clasp for mounting heavier, or heavier and larger ornamental objects having decorative elements such as a brooch so as to prevent slippage of, for example, a relatively heavy brooch, when mounted over the rear closure a bra or bikini, from moving relative to the rear closure. The cover and fastener for supporting bows etcetera as disclosed by Fisk are not useful in that, as taught, a heavy ornament such as a brooch, may readily rotate relative to the garment which has been merely sandwiched between the base and the folded-over front flap.

SUMMARY OF THE INVENTION

In summary, the decorative clasp for mounting the rear closure of a bra or bikini top includes a brooch or other decorative object (collectively herein a brooch) having a front surface and opposite back surface, wherein the front surface has mounted thereto decorative elements so as to adorn the brooch and wherein the back surface has a fastener mounted thereto. The fastener includes a base leg and a cooperating covering leg. The two legs cooperate so as to releasably clamp the rear closure of a bra or bikini top therebetween, wherein the base leg has a first interior surface and the covering leg has a second interior surface. The first and second interior surfaces are in opposed facing relation when the fastener is clamped onto the fabric of the rear closure.

A plurality of fabric penetrating protrusions such as teeth are formed or mounted (collectively referred to herein as being formed) on at least one of the first and second interior surfaces so that, when the fastener is clamped onto the fabric of the rear closure, the fabric penetrating protrusions penetratingly engage with the threads or nap of the fabric of the rear closure.

In one embodiment the base and or covering leg is substantially linear and substantially planar. The protrusions for penetrating the rear closure fabric may be advantageously in the range between substantially 1 and 3 millimeters in length, and may extend between 1 and 3 millimeters in elevation from the interior surfaces of the legs.

In an embodiment, not intended to be limiting the fastener includes a hinge between the base and covering legs, and further includes a resilient device cooperating between the legs so as to urge the legs together into a closed clamping position. For example, in that embodiment the base leg includes a base leg extension and the covering leg includes a covering leg extension, wherein the extensions extend from the hinge in a direction opposite to the legs. The resilient device may be mounted between, so as to urge apart, the extensions to thereby urge the legs together. In the illustrated embodiment the covering leg extension has an outer surface, and the covering leg extension and the outer surface extend beyond a corresponding edge of the front surface of the brooch. Further decorative elements are mounted onto so as to adorn the outer surface.

The brooch may have a laterally extending width which extends beyond a lateral width of the legs. The protrusions may be formed as an array extending as a plurality of protrusions across the lateral width of the legs.

It is understood that, as used herein, reference to brassiere, bra or bikini top is not intended to be limited to restrictive definitions of those items of apparel, but rather to garments of generally any kind such as bustiers, swim-suits, etcetera which have rear closures that are at the upper back of the garment so as to provide, when closed, support, at least in part, for the woman user's bust. The rear closures the present invention is intended to cover and decorate are of the genre which may have hook and loop elements where, depending on the desired tension and combined length of the straps or the like, some of the hooks may be visible to the rear of the apparel.

DETAILED DESCRIPTION OF EMBODIMENTS OF THE INVENTION

Figure 1:
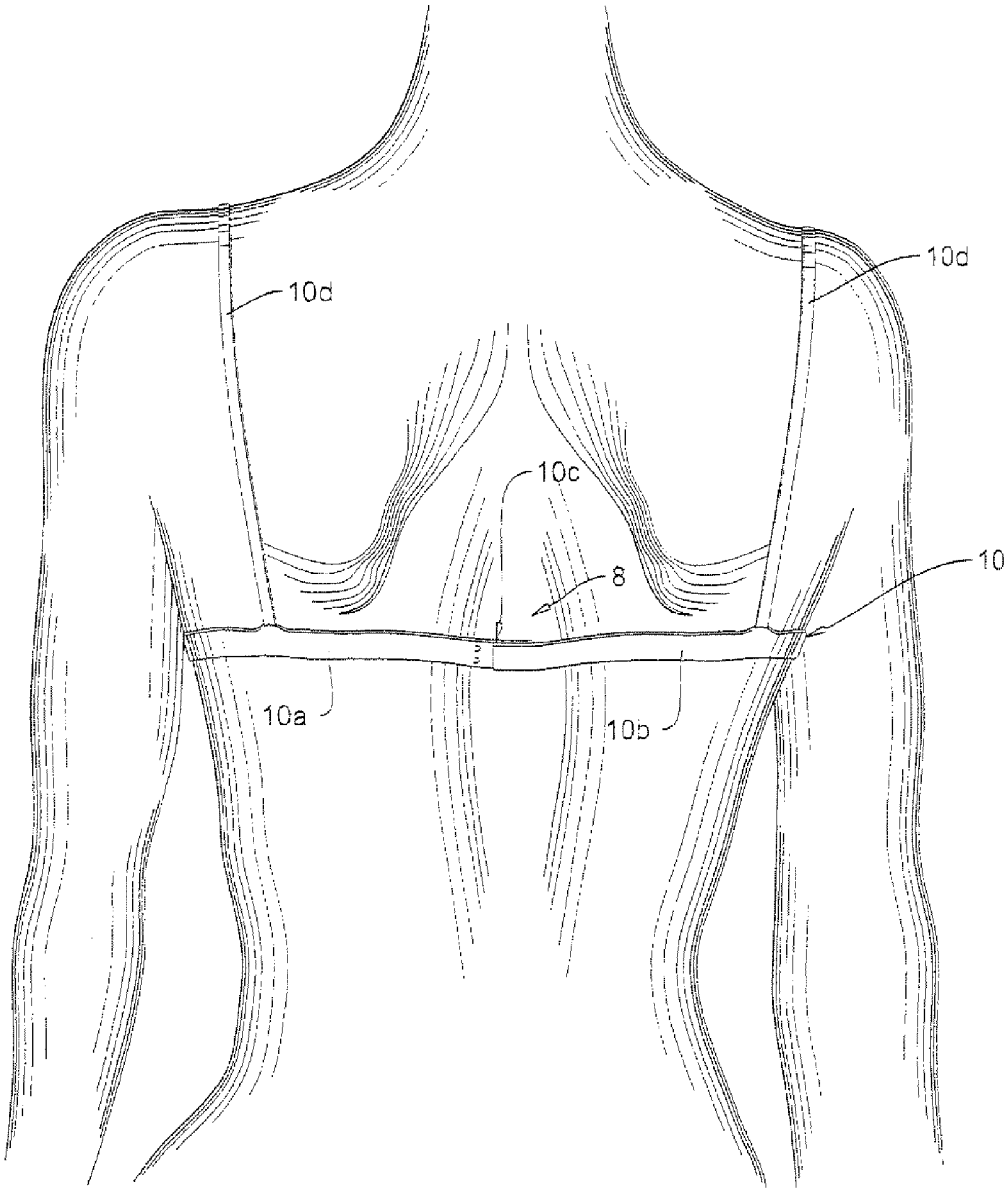
FIG 1 Prior Art
FIG. 1 is, in rear view, the back of a woman's torso wearing a conventional bra or bikini top, with the bra or bikini rear closure clasp fastened.

As seen in FIG. 1, the typically resilient back straps 10*a* and 10*b* of a bra or bikini 10 will typically have a fabric covered rear closure 10*c* having male and female cooperating fastening means for releasably and adjustably fastening the end of strap 10*a* to the corresponding end of strap 10*b*. Conventionally, an array of small loops may be provided on one of the ends and cooperating small hooks provided on the other of the ends so that the hooks may be releasably engaged into the loops so that the woman user may adjust the combined length of the back straps so as to provide both support and minimise discomfort. Consequently, given that the array of loops will by necessity will quite often be at least in part exposed, the rear closure 10*c* remains a very functional fastening arrangement typically lacking in aesthetic appeal. Where the rear closure 10*c* is that of a bikini top, the decorative aesthetic appeal may be provided by the decorative fabric or patterns on the fabric of the bikini top including its back straps, but not from the rear closure fastener per se. That is, the fastener of rear closure 10*c* often remains of the same design as that employed in undergarments and in particular that of the rear closure of a brassiere (herein also referred to as a bra), the bra typically not being intended to be viewed while worn.

It is thus sometimes desirable to add an overlaying ornamental object 12 so as to cover rear closure 10*c*.

Figure 2A:
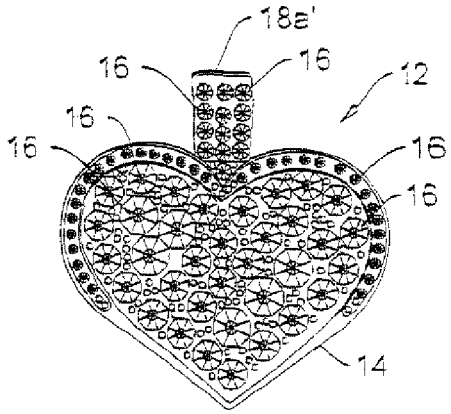
FIGS. 2*a*-2*c* are, respectively, front, back and perspective views of a heart-shaped brooch, the perspective view showing a close up of the mounting clip style fastener in its open position.
Figure 2E:
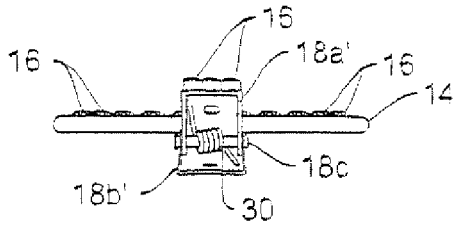
FIG. 2*e* is a top view of the brooch of FIG. 2*a*.
Figure 2B:
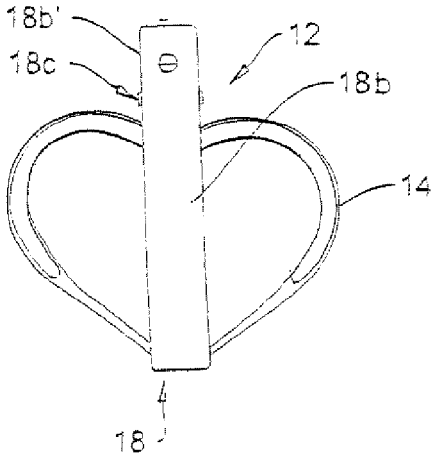
Figure 2C:
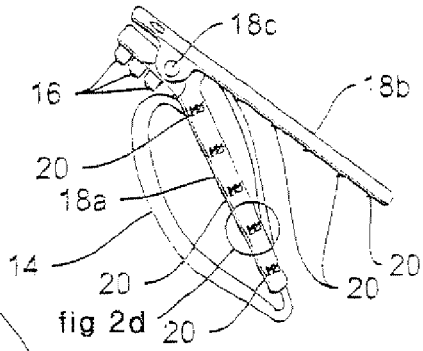
Figure 2D:
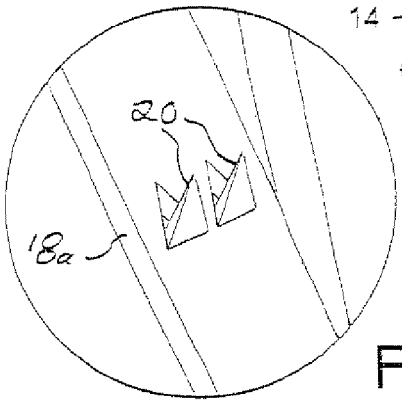
FIG. 2*d* is an enlarged view of a portion of FIG. 2*c*.

The ornamental object 12 may be as illustrated by way of example in FIGS. 2*a*-2*c*, a brooch 14. Brooch 14 may be of any decorative shape for example that of a heart as illustrated, although that is not intended to be limiting. The shape of the brooch may be the decorative aspect, in which case, depending on the thickness and material forming the brooch, the brooch may not be relatively heavy. However, where brooch 14 includes decorative elements such as rhinestones 16 or the like or other relatively dense decorative elements which are applied or mounted or formed as part of the brooch so as to be primarily viewable from the front of the brooch, the entire weight of the brooch may become significant relative to the amount of support which is provided by the combination of the bra straps 10*a* and 10*b* when fastened to each other by means of rear closure 10*c*. Thus typically the weight of the brooch may be governed by the amount of support which may be provided by the fastened back straps. If the back straps are, for example those of a bra having a wide back strap then brooch 14 may be heavier and still be supported without causing the back straps to droop or bow, as compared to the weight of a brooch which may be supported by a much thinner back strap or perhaps a less tensioned back strap for example perhaps that of a bikini top. In any event, it would be very undesirable if a fancy brooch 14 were to become askew or otherwise tilted when mounted on rear closure 10*c*, or worse yet, become entirely dislodged.

A typical location of a rear closure 10*c* and the nature of the conventional rear closure 10*c* is such that it provides a challenge to mounting relatively heavy brooches which cover the entire area of the rear closure and yet must be relatively easily installed and removed by the woman user. Part of the problem is that at rear closure 10*c*, there are two thicknesses of bra straps 10*a* and 10*b* to contend with, and the extent of overlap between them varies on the circumference of the woman users' torso and the desired amount of tension that the woman user will apply to the straps when closing the rear closure. In addition, often the rear closure 10*c* will be positioned over the spine of the woman user, in other words, over the slight depression usually formed by the spine in the back of the woman user so that rear closure 10*c* may sometimes be suspended out of contact with the spine as it crosses between the back muscles on either side of the spine. This then removes from being useful an area of the woman's skin in the depression which otherwise would provide surface friction to resist the movement or rotation of brooch 14 when mounted onto rear closure 10*c*.

Keeping these conditions in mind then, it was apparent to the applicant that merely sandwiching rear closure 10*c* between two flat surfaces, one mounted to the other as a flap, such as seen in the Fisk prior art would risk allowing a brooch 14 for example to rotate relative to rear closure 10*c*, unless rear closure 10*c* was sandwiched therebetween with considerable force. Use of such force would then add strain to the fastener components of the brooch and possibly make closing of the fastener difficult for the user, especially given that the woman user is reaching around behind her back to engage the fastener. Thus a modified clip 18 was designed by applicant to overcome the short comings of the prior art and to accommodate the difficult conditions presented by rear closure 10*c*. In particular, clip 18 is provided with a base leg 18*a* and a covering leg 18*b*, wherein fabric penetrating protrusions such as, without intending to be limiting, serrations or teeth 20 are provided on the inner surfaces of the base and/or cover legs so as to engage the fibres or nap of the fabric or material (collectively referred to herein as fabric) forming the ends of straps 10*a* and 10*b* at rear closure 10*c* that is, covering rear closure 10*c*. An array of serrations or teeth 20 may advantageously be provided along the length of the base and/or cover legs 18*a* and 18*b* respectively. Serrations or teeth 20 need only protrude sufficiently from the interior surfaces of the base and/or cover legs so as to engage into the fabric or nap of the material at rear closure 10*c*, so that, protrusions in the order of a millimeter to several millimeters may typically suffice.

Thus with cover leg 18*b* engaged over rear closure 10*c*, for example so as to be interleaved between rear closure 10*c* and the spine 8 of the woman user, and with cover leg 18*b* mounted to base leg 18*a* at either its upper or lower end by means of for example a hinge 18*c*, whether a single piece or not, or other flap or pivot arrangement, cover leg 18*b* may be brought together with base leg 18*a* so as to close the clip fastener if provided thereby sandwiching rear closure 10*c* between the base and cover legs 18*a* and 18*h* respectively.

In the embodiment illustrated, spring 30 acting on base leg extension 18*b*' and cover leg extension 18*a*', replaces the use of a clip fastener per se as the spring urges the two legs 18*a* and 18*b* together so as to engage the teeth 20 onto the rear closure 10*c*.

With rear closure 10*c* so clamped between the base and cover legs, serrations or teeth 20 slightly bite into the fabric or nap of the material at rear closure 10*c* so as to thereby resist relative movement between the ornamental object, for example brooch 14, and rear closure 10*c*.

As will now be appreciated, the larger the ornamental object 12, for example the wider brooch 14, the wider may be the contact opposed facing surfaces of the cover legs 18*a* and 18*b* respectively. The larger the contact area, and presuming that serrations or teeth 20 are provided across the contact area on one or both the inside surfaces of the base and/or cover legs, and the further spaced apart along the rear closure 10*c* and the corresponding ends of the bra straps are the biting engagement of the teeth into the material of the bra straps or rear closure 10*c*, the better resistance is provided to both relative vertical movement of the ornamental object 12 relative to the bra straps, and to torsion applied to the ornamental object which will result in rotation or misalignment of the ornamental object 12 relative to the bra straps. Thus to achieve this, for a relatively wide object, for example brooch 14, more than one clip 18 may be provided spaced apart laterally across the back of the brooch or other ornamental object, thus providing improved stability to the mounting of the brooch onto the bra straps and to provide the added back up in the event that one of the clips inadvertently becomes opened and releases the straps or rear closure, the remaining closed clip retaining the brooch in place so as to prevent the brooch becoming entirely dislodged.

Figure 3:
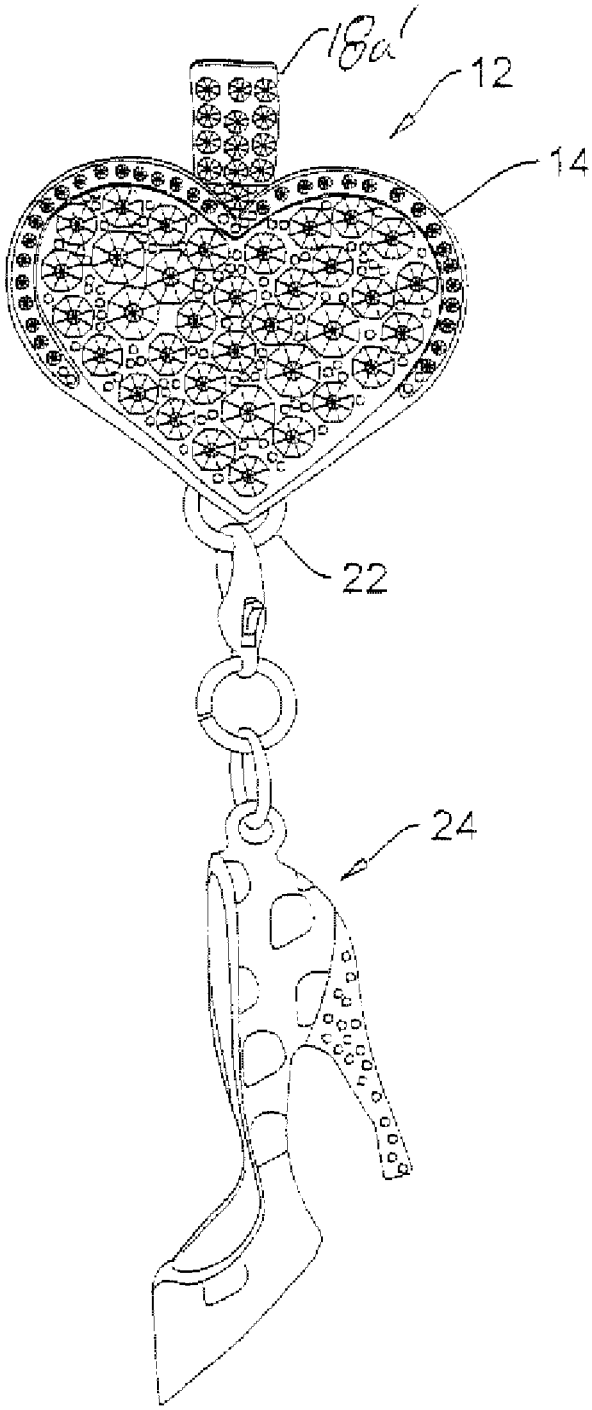
FIG. 3 is, in front view, the brooch of FIG. 2*a* with a lower loop mounted at the bottom of the brooch and a pendant mounted to the loop.
Figure 4:
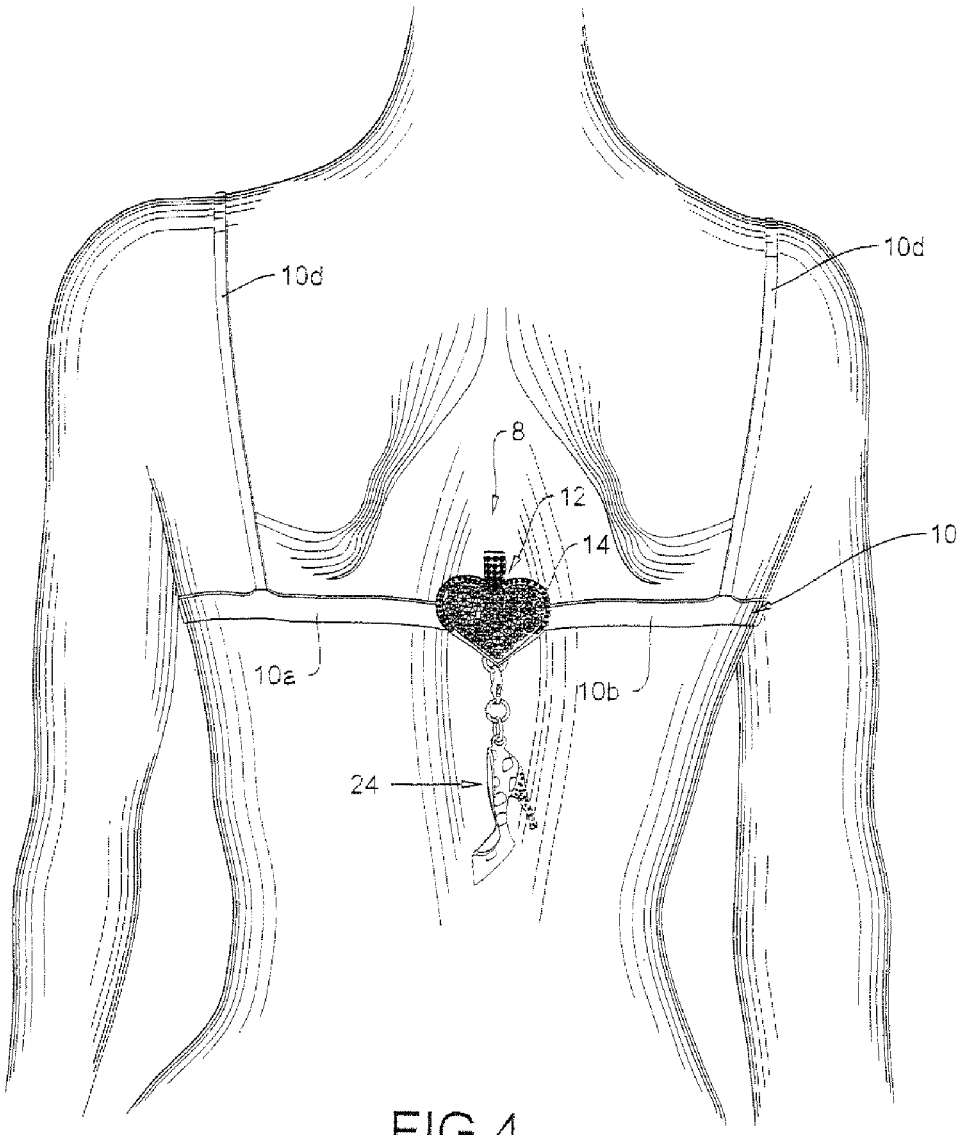
FIG. 4 is the view of FIG. 1 with the heart-shaped brooch of FIG. 2*a* mounted onto the rear closure.

The stability of the fastening provided by the present invention will be further appreciated when other embodiments of decorative elements such as seen in FIGS. 3-6 are considered. Thus, as seen in FIG. 3, it may be that a loop 22 or eye or ring is fastened to a lower edge of an ornamental object 12 so as to suspend therefrom items having weight for example a pendant 24.

Figure 5A:
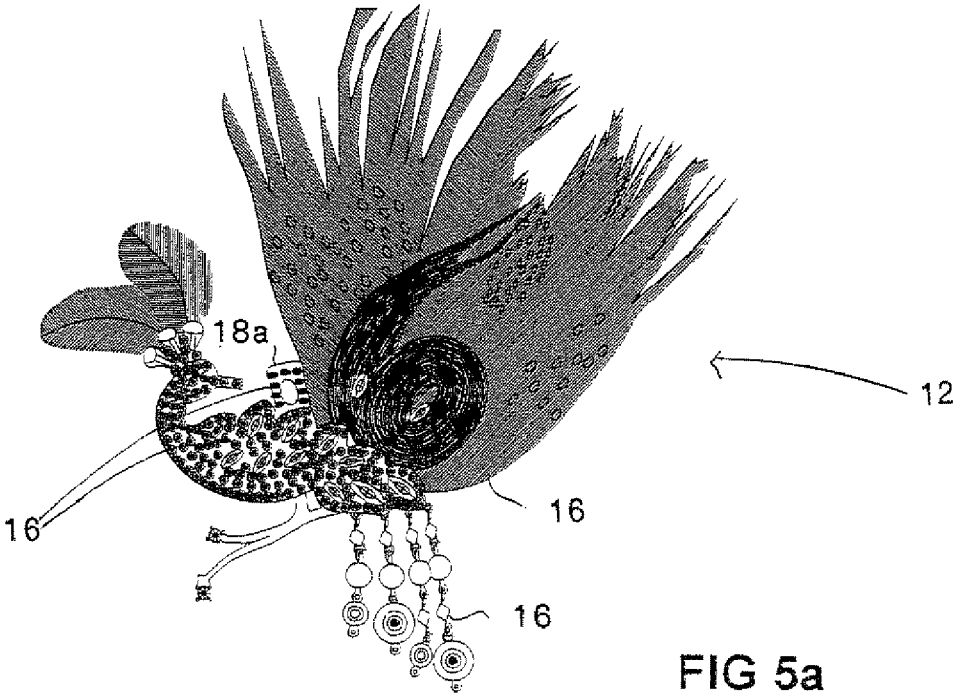
FIGS. 5*a* and 5*b* are, respectively, front and back views of a further brooch having the fastening device according to one aspect of the present invention thereon.
Figure 5B:
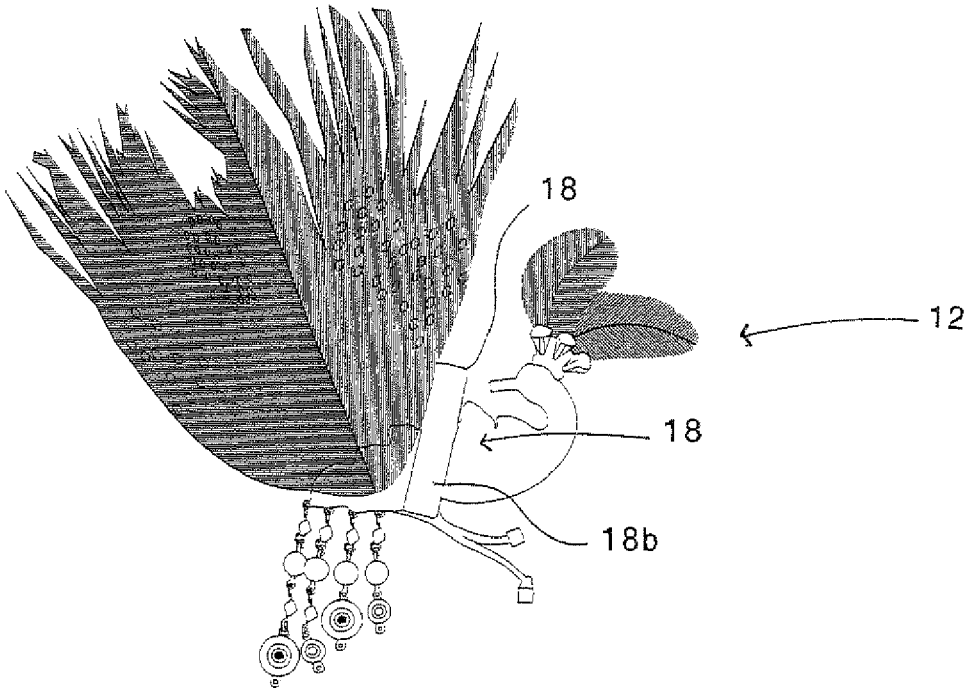
Figure 6:
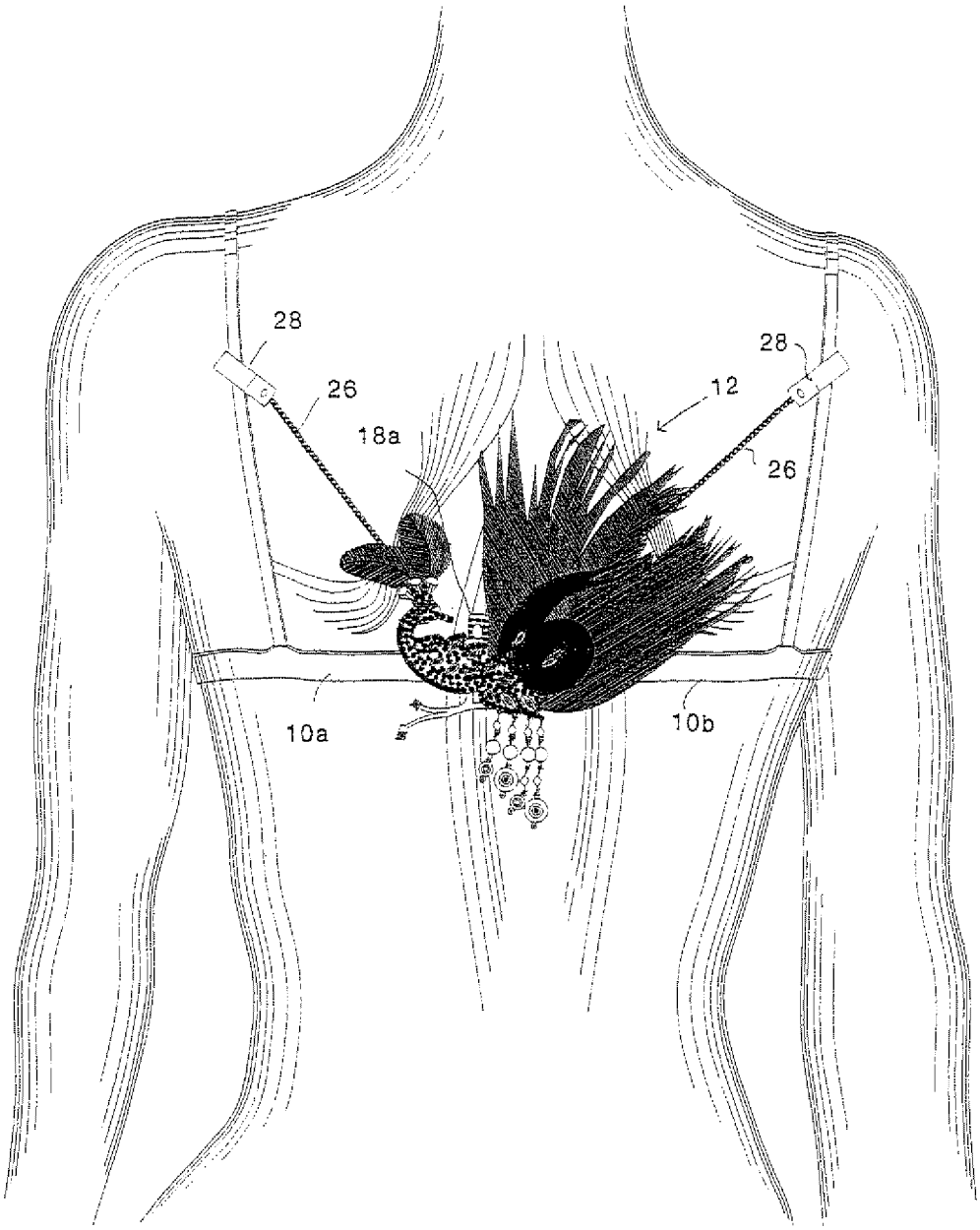
FIG. 6 is the view of FIG. 1 with the brooch of FIG. 5*a* mounted to the rear closure, and further illustrating an optional supporting arrangement of a pair of light chains.

In the further embodiment of FIGS. 5 and 6 which represents exotic ornamental objects it can be seen that even if the object is not particularly heavy, it will still exert possibly considerable torque about rear closure 10*c* do to its mere size and the resulting bending arm pivoting about the rear closure. Again, because of its increased size, additional stability may be provided by the use of more than one clip 18 or laterally oversized clip 18. In more extreme cases, or in cases where the woman user desires the aesthetic extra appeal of support chains 26, support chains 26 may be provided or other decorative flexible elongate members which may then provide support in tension to help support an enlarged ornamental object 12 which otherwise would be supported by its mounting onto rear closure 10*c* using clip or clips 18 according to one aspect of the present invention. As may be seen, support chains 26 may attach to bra shoulder straps 10*d* by means of, for example, small clamps 28 on the ends of the chain, wherein, advantageously, clamps 28 may be smaller versions of clips 18.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A decorative clasp for mounting to a brassiere or bikini top having a fabric covered conventional rear closure comprising in combination:

a brassiere or bikini top having a fabric covered rear closure, a brooch having a front surface and opposite back surface, wherein said front surface has mounted thereto decorative elements so as to adorn said decorative object, and wherein said back surface has a fastener mounted thereto, said fastener including a base leg and a cooperating covering leg cooperating so as to releasably clamp said fabric covered rear closure therebetween, wherein said base leg has a first interior surface and said covering leg has a second interior surface, said first and second interior surfaces in opposed facing relation when said fastener is clamped onto said fabric covered rear closure, a plurality of fabric penetrating protrusions formed on at least one of said first and second interior surfaces so that, when said fastener is clamped onto said fabric covered rear closure, said fabric penetrating protrusions penetratingly engage said fabric covered rear closure.

2. The decorative clasp of claim 1 wherein said base leg is substantially linear and substantially planar.

3. The decorative clasp of claim 2 wherein said covering leg is substantially linear and substantially planar.

4. The decorative clasp of claim 1 wherein said protrusions are teeth.

5. The decorative clasp of claim 1 wherein said protrusions are between substantially 1 and 3 millimeters in length.

6. The decorative clasp of claim 4 wherein said teeth are between substantially 1 and 3 millimeters in length.

7. The decorative clasp of claim 1 wherein said protrusions extend between 1 and 3 millimeters in elevation from said interior surfaces.

8. The decorative clasp of claim 4 wherein said teeth extend between 1 and 3 millimeters in elevation from said interior surfaces.

9. The decorative clasp of claim 1 wherein said fastener includes a hinge between said base and covering legs, and further includes a resilient device cooperating between said legs so as to urge said legs together into a closed clamping position.

10. The decorative clasp of claim 9 wherein said base leg includes a base leg extension and said covering leg includes a covering leg extension, wherein said extensions extend from said hinge in a direction opposite to said legs.

11. The decorative clasp of claim 10 wherein said resilient device is mounted between, so as to urge apart, said extensions to thereby urge said legs together.

12. The decorative clasp of claim 10 wherein said covering leg extension has an outer surface, and wherein said covering leg extension and said outer surface extend beyond a corresponding edge of said front surface of said decorative object, and wherein decorative elements are mounted onto so as to adorn said outer surface.

13. The decorative clasp of claim 1 wherein said brooch has a laterally extending width which extends beyond a lateral width of said legs.

14. The decorative clasp of claim 13 wherein said protrusions are formed as an array extending as a plurality of said protrusions across said lateral width of said legs.

15. A method for decorating a conventional fabric covered rear closure of a brassiere or bikini top with a decorative clasp, the method comprising:

a) providing a brassiere or bikini top having a fabric covered rear closure, b) providing a brooch having a front surface and opposite back surface, wherein said front surface has mounted thereto decorative elements so as to adorn said decorative object, and wherein said back surface has a fastener mounted thereto, and wherein said fastener includes a base leg and a cooperating covering leg cooperating so as to releasably clamp said fabric covered rear closure therebetween, wherein said base leg has a first interior surface and said covering leg has a second interior surface, said first and second interior surfaces in opposed facing relation when said fastener is clamped onto said fabric covered rear closure, a plurality of fabric penetrating protrusions formed on at least one of said first and second interior surfaces, c) securing said fastener is clamped onto said fabric covered rear closure so that said fabric penetrating protrusions penetratingly engage said fabric covered rear closure of said brassiere or bikini top, whereby securement of the decorative object and decoration for a desired aesthetic effect is achieved.

16. The method of claim 14 wherein said providing of said protrusions includes providing teeth as said protrusions.

* * * * *